US006694647B1

(12) United States Patent
Patterson et al.

(10) Patent No.: US 6,694,647 B1
(45) Date of Patent: Feb. 24, 2004

(54) BIO-MECHANICALLY EXTENDED HEEL FOR GOLF SHOE

(75) Inventors: Chad Patterson, West Springfield, MA (US); Joel A. Singer, Quincy, MA (US)

(73) Assignee: Etonic Worldwide LLC, Waltham, MA (US)

( * ) Notice: Subject to any disclaimer, the term of this patent is extended or adjusted under 35 U.S.C. 154(b) by 493 days.

(21) Appl. No.: 09/320,104

(22) Filed: May 26, 1999

(51) Int. Cl.[7] ..... A43B 5/00

(52) U.S. Cl. ..... 36/127; 36/59 R; 36/67 A; 36/59 C

(58) Field of Search ..... 36/25 R, 127, 36/92, 142, 143, 144, 59 C, 59 R, 103, 31, 32 R, 67 A; D2/962, 954, 947–960

(56) References Cited

U.S. PATENT DOCUMENTS

| | | | | | |
|---|---|---|---|---|---|
| 1,870,751 | A | * | 8/1932 | Reach | 36/25 R |
| 3,492,744 | A | | 2/1970 | Bernier et al. | 36/59 |
| 3,559,308 | A | | 2/1971 | Bernier et al. | 36/2.5 |
| 4,180,924 | A | * | 1/1980 | Subotnick | 36/25 R |
| 4,580,359 | A | | 4/1986 | Kurrash et al. | 36/127 |
| 4,885,851 | A | * | 12/1989 | Peterson | 36/127 |
| 4,937,954 | A | * | 7/1990 | Clement | 36/127 |
| 5,265,354 | A | * | 11/1993 | Aliano, Jr. | 36/25 R |
| 5,448,839 | A | * | 9/1995 | Blissett et al. | 36/25 R |
| 5,806,209 | A | * | 9/1998 | Crowley et al. | 36/28 |
| D403,147 | S | | 12/1998 | Erickson | D2/962 |
| 5,921,004 | A | * | 7/1999 | Lyden | 36/25 R |
| 6,108,943 | A | * | 8/2000 | Hudson et al. | 36/102 |

* cited by examiner

*Primary Examiner*—Jila M. Mohandesi
(74) *Attorney, Agent, or Firm*—Lahive & Cockfield, LLP

(57) ABSTRACT

A golf shoe includes an outsole having a sole member. The sole member has a sole, a heel, and an arch disposed intermediate the sole and heel. The sole and heel each have a ground engagement surface. The heel has a centerline and left and right side portions disposed on either side of the centerline. The left side portion of the heel (the medial side portion for the right golf shoe and the lateral side portion for the left golf shoe) includes a flare having a ground engagement surface. The ground engagement surfaces of the flare and left side portion of the heel have an area which is greater than the area of the ground engagement surface of the right side portion of the heel.

7 Claims, 4 Drawing Sheets

BIO-MECHANICALLY EXTENDED HEEL FOR GOLF SHOE

BACKGROUND OF THE INVENTION

The present invention relates to shoes, and more particularly to sports shoes intended for use while playing golf.

Golf shoes are typically comprised of a shoe upper which is attached to some or all of an inner sole, a mid-sole and an outsole. For many years, golf shoes have employed spikes to increase the traction between the shoe and the grass of the golf course and thereby improve the golfer's footing. More recent golf shoes have employed pyramid-shaped protrusions alone, or in combination with spikes to provide improved traction.

The improvement in traction which may be provided by such devices is limited by several factors. First, improving traction using such devices can result in decreased mobility. A device that tends to freeze the shoe in a set position on the surface of the golf course also resists the movement of the shoe that is required when the golfer walks from one place to another. For example, golf spikes have a length which is sufficiently long to improve traction between the shoe and the ground but is also sufficiently short to allow the spikes to be easily withdrawn from the ground. Second, the number of traction-enhancing devices which may be added to the golf shoe outsole is limited by the area of the shoe footprint. If the devices are crowded too closely together, the individual engagement surfaces of the devices will approximate a smooth engagement surface and support the shoe on the surface rather than penetrating the surface.

SUMMARY OF THE INVENTION

Briefly stated, the invention in a preferred form is a golf shoe which includes an outsole including a sole member having a sole, a heel, and an arch disposed intermediate the sole and heel. The sole and heel each have a ground engagement surface. Multiple traction enhancing elements extending outwardly from the ground engagement surfaces of the heel and sole. The heel has a centerline and left and right side portions disposed on either side of the centerline. The left side portion of the heel (the medial side portion for the right golf shoe and the lateral side portion for the left golf shoe) includes a flare having a ground engagement surface. The ground engagement surfaces of the flare and left side portion of the heel have an area which is greater than the area of the ground engagement surface of the right side portion of the heel.

The flare has a first flare region defining a laterally extending ground engagement surface and a second flare region defining a ground engagement surface extending forward of the front surface of the right side portion. The side surface of the first flare region extends upwardly from the ground engagement surface and inwardly toward the centerline. At least a part of at least one of the traction enhancing elements extends from the ground engagement surface of the flare.

It is an object of the invention to provide a new and improved golf shoe.

It is also an object of the invention to provide a golf shoe that has improved traction with the ground.

It is further an object of the invention to provide a golf shoe that provides greater stability during the golfer's downswing.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DESCRIPTION OF THE PREFERRED EMBODIMENTS

Figure 1:
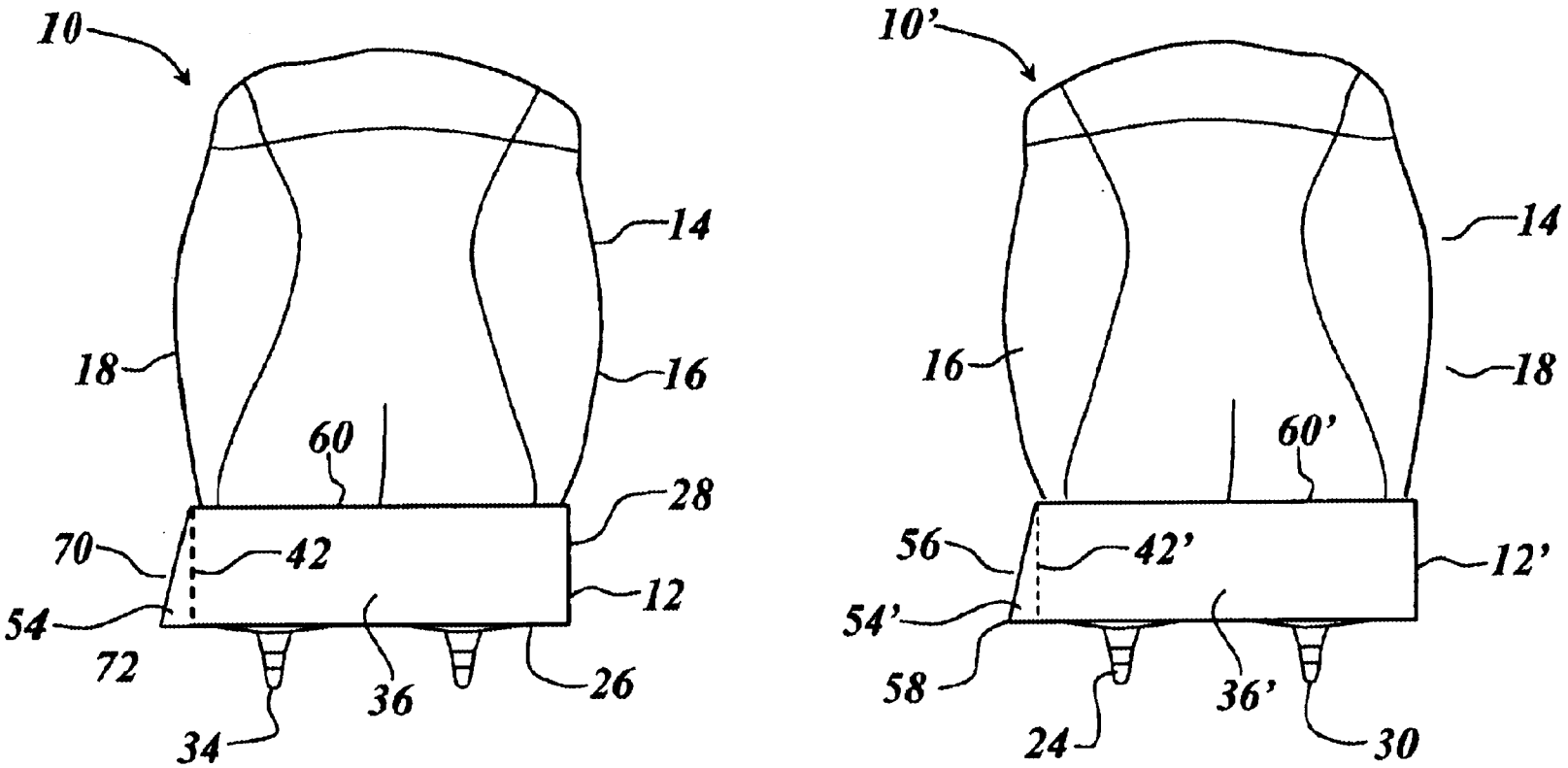
FIG. 1 is a rear view of a pair of golf shoes in accordance with the present invention.

With reference to the drawings wherein like numerals represent like parts throughout the several figures, a golf shoe in accordance with the present invention is generally designated by the numeral 10. As shown in FIG. 1, an outsole 12, 12' is mounted to an inner sole (not shown) and an upper 14 to form a golf shoe 10, 10'. The shoe upper 14 and the shoe inner sole are well known in the art and may be comprised of any material suitable for use while playing golf. The golf shoe 10, 10' may also include a mid-sole (not shown).

Figure 5:
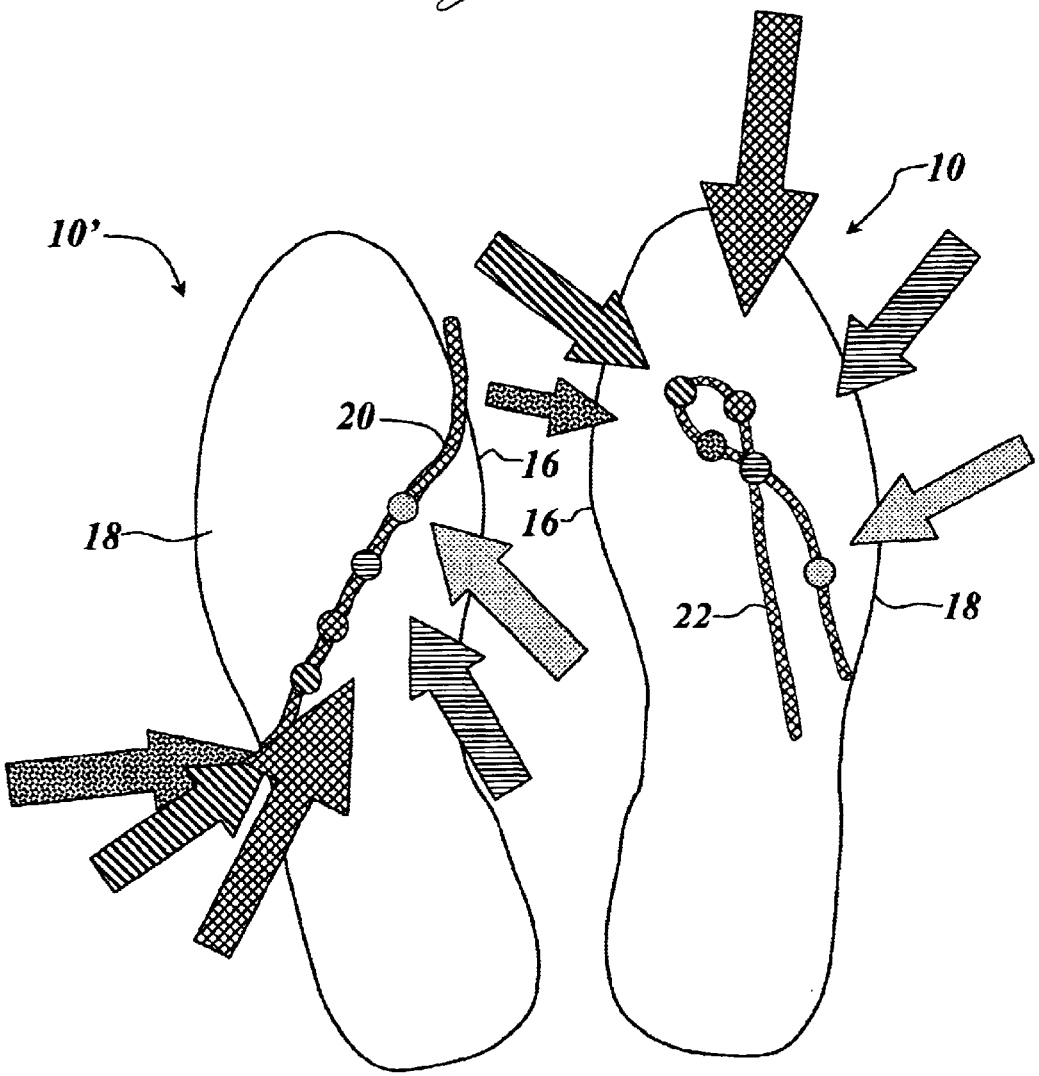
FIG. 5 is a schematic bottom view of a golfer's left and right shoes illustrating the path of the center of pressure and the direction and relative magnitude of the forces exerted during the golfer's downswing.

The traction between both the golfer's right and left shoes 10', 10 is lowest during the golfer's downswing because shear forces acting parallel to the ground surface are high and vertical forces change as the weight is shifted from the right foot to the left foot (for a right-handed golfer). As the downswing progresses, the left shoe 10 rolls from the medial side 16 (inside) of the left foot toward the lateral side 18 (outside) while the right foot rolls from the lateral side 18 of the right foot toward the medial side 16. In addition, the center of pressure 20 for the right shoe 10' traverses the sole of the shoe from the lateral side to the medial side 16 and the center of pressure 22 for the left shoe 10 moves in a rough figure-8 shaped pattern extending from the lateral side 18 to the middle of the sole, as illustrated in FIG. 5.

To reduce the probability of slippage between the golf shoe 10, 10' and the course surface, the outsole 12, 12' includes a variety of traction-enhancing elements 24 that extend downwardly from the outer surface 26 of the sole member 28. Such traction-enhancing elements 24 generally distinguish golf shoes 10, 10' from regular street shoes. The traction-enhancing elements 24 include soft spikes 30 and pyramid-shaped protrusions 32. The tips 34 of the spikes and/or protrusions penetrate the surface of the ground to increase the traction between the shoe 10, 10' and the ground and to resist shear forces to which the shoe 10, 10' may be subjected.

In a conventional golf shoe, the medial and lateral halves of the heel are generally mirror images and have substantially equal surface areas for contacting the ground. In a heel 36, 36' in accordance with the subject invention, flares 38, 38' have been added to the left portion 40 of the heel 38, 38' of each shoe 10, 10' (the lateral portion 41 of the heel 36 of the left shoe 10 and the medial portion 43 of the heel 36' of the right shoe 10').

Figure 2:
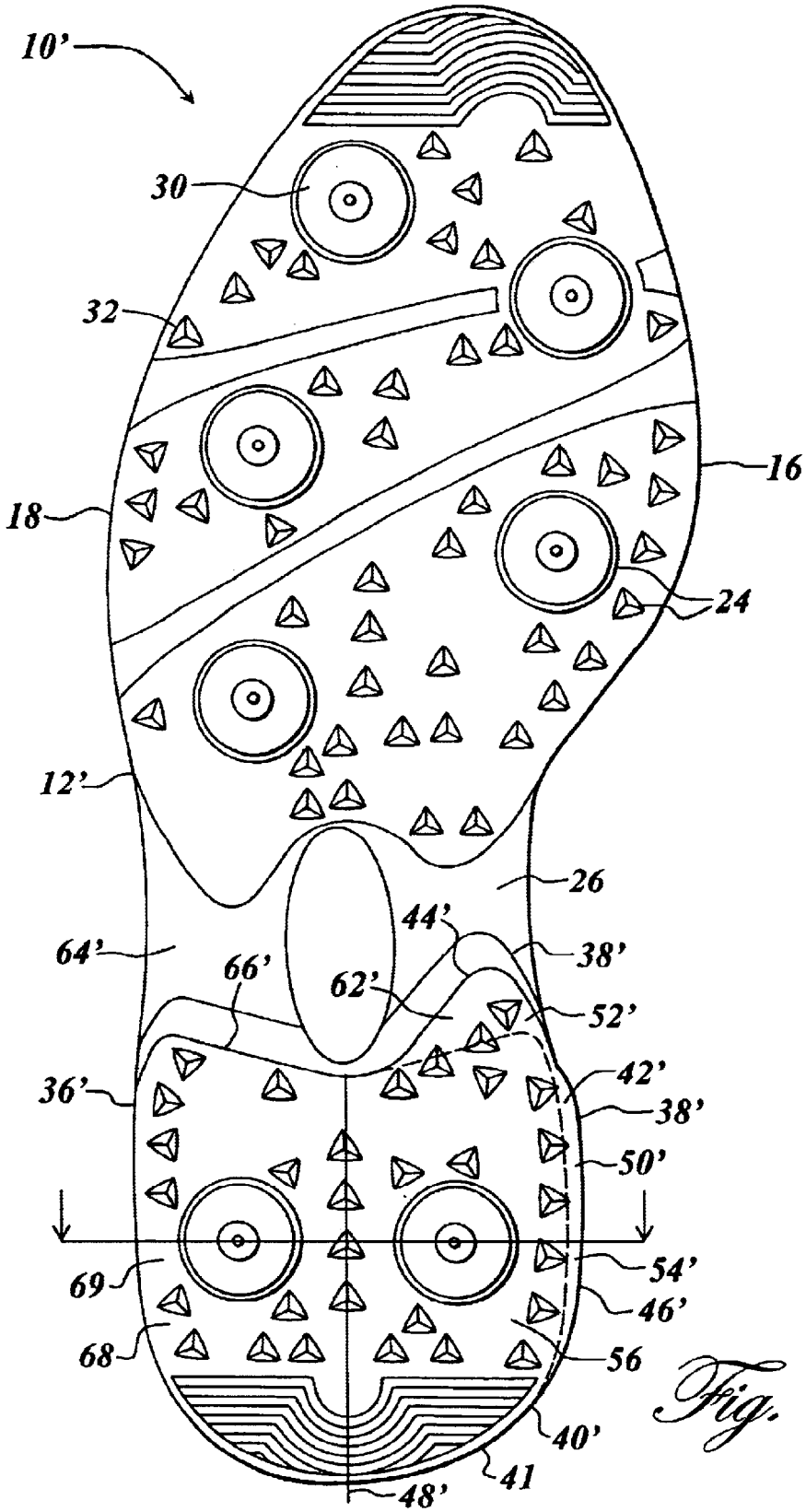
FIG. 2 is an enlarged bottom view of the right golf shoe of FIG. 1.
Figure 3:
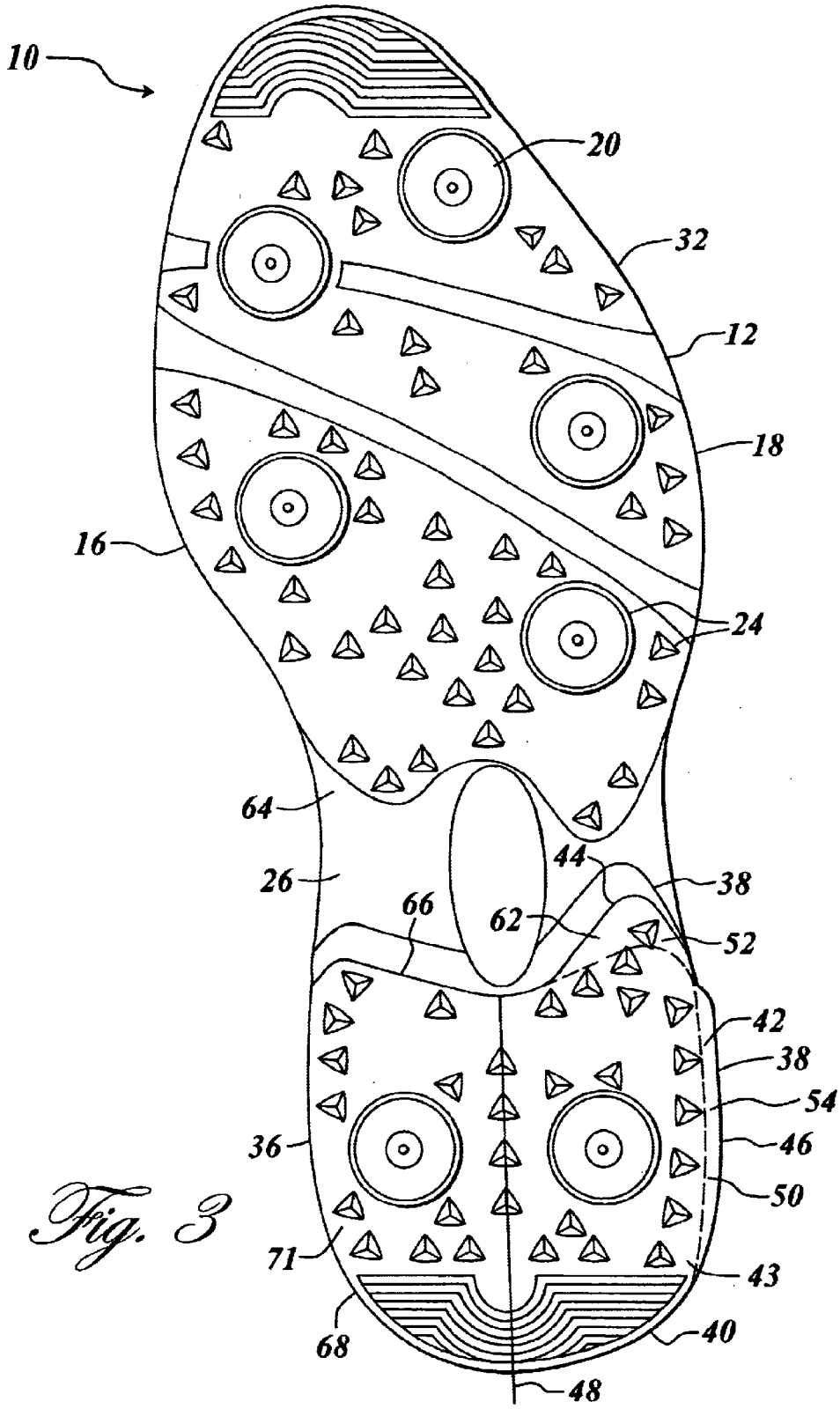
FIG. 3 is an enlarged bottom view of the left golf shoe of FIG. 1.
Figure 4:
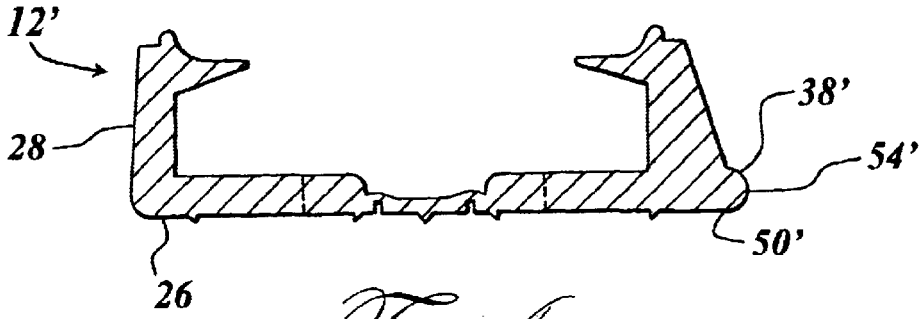
FIG. 4 is a cross-section view, taken along line 4—4, of the outsole of the right golf shoe of FIG. 2.

The flares 38, 38' are shown in FIGS. 2 and 3 as the heel structure which extends between the front and side surfaces 42, 42' of a conventional heel left portion (shown in dotted line) and the front surface 44, 44' and side surface 46, 46' of the subject heel left portion (shown in solid line). The flares 38, 38' provide additional surface area to the left of the heel centerline 48, 48' for contacting the ground. The ground contacting surface area 50, 50', 52, 52' of the flares 38, 38' provide greater stability and further improve the traction between the shoes 10, 10' and the ground surface.

With reference to FIGS. 1 and 2, the heel 36' of the right shoe 10' includes a first flare region 54' which has a bottom surface 50' which extends laterally outward from what would have been side 10 surface 42' in a traditional golf shoe. The medial side 56 of the heel 36' slopes upward from the medial edge 58 of the first flare region 54' to the top 60' of the heel 36' to reduce the total amount of material which is added to the heel 36'. A second flare region 62' extends forward from what would have been front surface 42' of the traditional heel and beyond the front surface 66' of the right part 68' of the heel 36' (the right part 68' of the heel 36' of the right shoe 10' is also the lateral part 69 of the heel 36') into the arch area 64'.

With reference to FIGS. 1 and 3, the heel of the left shoe 10 also includes first and second flare regions 54, 62. The first flare region 54 has a bottom surface 50 which extends laterally outward from what would have been the side surface 42 in a traditional golf shoe. The lateral side 70 of the heel 36 slopes upward from the lateral edge 72 of the first flare region 54 to the top 60 of the heel 36 to reduce the total amount of material which is added to the heel 36. The second flare region 62 extends forward beyond the front surface 66 of the right part 68 of the heel 36 (the right part 68 of the heel 36 of the left shoe 10 is also the medial part 71) forward into the arch area 64.

As stated above, the right foot rolls from the lateral side of the right foot toward the medial side during the downswing. As the foot rolls off the outside of the shoe 10' toward the inside, the surface area 50', 52' of the first and second flare regions 54', 62' provides a greater surface area which remains in contact with the ground surface. Similarly, the surface area 50, 52 of the first and second flare regions 54, 62 of the left shoe 10 provide a greater surface area-which remains in contact with the ground surface as the left shoe 10 rolls from the inside of the left foot toward the outside of the left foot. The flares 38, 38' also provide a place an additional area in which spikes 30 and protrusions 32 may be positioned. Essentially, the flares 38, 38' extend the base of support for both shoes 10, 10' in the direction that the golfer's weight shifts during the downswing.

Flares are not required on the medial side 16 of the left shoe 10 and the lateral side 18 of the right shoe 10' (that is the right side of either shoe). During the downswing the medial side 16 of the left shoe 10 and the lateral side 18 of the right shoe 10' support very little of the golfer's weight. In fact, the golfer lifts the heel 36' of the right shoe 10' off of the ground at the end of the downswing. Flares on the medial side 16 of the left shoe 10 and the lateral side 18 of the right shoe 10' would provide more support to the golfer during the golfer's upswing. However, due to the nature of the upswing, such extra support would provide little or no benefit to the golfer. Consequently flares are not added to these two sides of the shoe 10, 10' to prevent the addition of unnecessary weight to the shoes 10, 10'.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. An outsole for both a right and a left golf shoe having improved traction with the ground, the outsole comprising:

a sole member having a sole, a heel, and an arch disposed intermediate the sole and heel, the sole and heel each having a ground engagement surface, the heel having a centerline and left and right side portions disposed on either side of the centerline; and a plurality of traction enhancing elements extending outwardly from the ground engagement surfaces of the heel and sole of the sole member;

wherein the right side portion of the heel has a front surface and the left side portion of the heel includes a flare, the flare having a ground engagement surface, the ground engagement surfaces of the flare and left side portion of the heel having an area which is greater than the area of the ground engagement surface of the right side portion of the heel, the flare including a first flare region having a laterally extending ground engagement surface and a second flare region having a ground engagement surface extending forward of the front surface of the right side portion of the heel.

2. The outsole of claim 1 wherein the first flare region further has a side surface extending vertically upward from the ground engagement surface and laterally inward toward the centerline.

3. The outsole of claim 1 wherein at least a part of at least one of the traction enhancing elements extends from the ground engagement surface of the flare.

4. A right and left golf shoe outsole comprising:

a sole defining a front portion of the outsole and having a ground engagement surface;

a heel defining a rear portion of the outsole, the heel having a ground engagement surface, a centerline, and left and right side portions disposed on either side of the centerline, the right side portion of the heel having a front surface, the left side portion of the heel including a flare having a ground engagement surface, the flare including a first flare region having a laterally extending ground engagement surface and a second flare region having a ground engagement surface extending forward of the front surface of the right side portion of the heel;

an arch disposed intermediate the sole and heel; and a plurality of traction enhancing elements extending outwardly from the ground engagement surfaces of the heel and sole, at least a part of at least one of the traction enhancing elements extending from the ground engagement surface of the flare.

5. The outsole of claim 4 wherein the ground engagement surfaces of the flare and left and right side portions of the heel each have an area, the sum of the areas of the ground engagement surfaces of the flare and the left side portion of the heel being greater than the area of the ground engagement surface of the right side portion of the heel.

6. A pair of outsoles for right and left golf shoes comprising:

a right outsole having a sole having a ground engagement surface; and a heel having a ground engagement surface, a centerline, and medial and lateral side portions disposed on either side of the centerline, the lateral side portion of the heel of the right outsole having a front surface, the medial side portion of the heel including a flare comprising a first flare region having a laterally extending ground engagement surface and a second flare region having a ground engagement surface extending forward of the front surface of the lateral side portion of the heel, the ground engagement surfaces of the flare and medial side portion of the heel having an area which is greater than the area of the ground engagement surface of the lateral side portion of the heel; and a left outsole having a sole having a ground engagement surface; and a heel having a ground engagement surface, a centerline, and medial and lateral side portions disposed on either side of the centerline, the medial side portion of the heel of the left outsole having a front surface, the lateral side portion of the heel including a flare comprising a first flare region having a laterally extending ground engagement surface and a second flare region having a ground engagement surface extending forward of the front surface of the medial side portion of the heel, the ground engagement surfaces of the flare and lateral side portion of the heel having an area which is greater than the area of the ground engagement surface of the medial side portion of the heel.

7. The pair of outsoles of claim 6 wherein the right and left outsoles each further have a plurality of traction enhancing elements, at least a part of at least one of the traction enhancing elements extending from the ground engagement surface of the flare.

* * * * *